United States Patent [19]

Carter et al.

[11] Patent Number: 4,618,009

[45] Date of Patent: Oct. 21, 1986

[54] REAMING TOOL

[75] Inventors: Thurman B. Carter, Tuttle; Carl D. Reynolds, Oklahoma City, both of Okla.; Larry R. Mundorf, Bakersfield, Calif.

[73] Assignee: Homco International Inc., Houston, Tex.

[21] Appl. No.: 638,700

[22] Filed: Aug. 8, 1984

[51] Int. Cl.[4] ..... E21B 9/26

[52] U.S. Cl. ..... 175/267; 175/269

[58] Field of Search ..... 175/267, 263, 273, 279, 175/286, 289, 406

[56] References Cited

U.S. PATENT DOCUMENTS

| | | | |
|---|---|---|---|
| 1,589,508 | 6/1926 | Boynton . | |
| 2,069,482 | 2/1937 | Seay . | |
| 2,177,721 | 10/1939 | Johnson et al. | 175/267 X |
| 2,457,628 | 12/1948 | Baker . | |
| 2,679,383 | 5/1954 | Garrison . | |
| 2,743,904 | 5/1956 | Scott . | |
| 2,755,070 | 7/1956 | Kammerer, Jr. . | |
| 2,847,189 | 8/1958 | Shook . | |
| 2,872,160 | 2/1959 | Barg . | |
| 2,910,274 | 10/1959 | Scott . | |
| 3,196,960 | 7/1965 | Kammerer | 175/267 |
| 3,419,077 | 12/1968 | Sanford | 166/55.8 |
| 3,757,876 | 9/1973 | Pereau | 175/267 |
| 3,757,877 | 9/1973 | Leathers | 175/269 |
| 4,169,510 | 10/1979 | Meigs | 175/65 |

OTHER PUBLICATIONS

Al Tech Specialty Steel Corporation Bulletin "Al Tech Arapaho" 1982.

A-1 Bit & Tool Company, 1982-83 general catalogue.

*Primary Examiner*—Stuart S. Levy

*Assistant Examiner*—Thomas R. Hannon

*Attorney, Agent, or Firm*—M. J. McGreal

[57] ABSTRACT

A narrow diameter reaming tool can ream a hole which is up to ten times the diameter of the tool. The cutting arms of the tool are of a type such that if there is an excessive load on an arm, the arm will fracture rather than bend.

24 Claims, 13 Drawing Figures

REAMING TOOL

This invention relates to a reaming tool apparatus for increasing the diameter of a hole which has been bored in the ground. More particularly, this invention relates to a reaming tool which can increase the diameter of a hole to up to ten times the diameter of the tool.

The present reaming tool can be used to increase the diameter of a segment of a hole. This widening will usually take place from 100 to 10,000 or more feet underground. This widening can be a belling and it can be a widening of a segment for a number of feet beyond the bell. In widening the hole beyond the bell shaped hole, formed by the gradual extension of cutting arms, the drill string is moved upwardly after the cutting arms have become fully extended. However, in another embodiment the bell shaped portion of the hole can be expanded to a hole of constant diameter by having cutting surfaces on both the upper and lower surfaces of the cutting arms, and after the cutting arms are fully extended, to cut downward and expand the hole to a constant diameter. This constant diameter will be equal to the width of the tool from extended cutting arm to extended cutting arm.

The present reaming tool is particularly useful for increasing the diameter of an oil or gas well. However, it can also be used to make holes for foundations, underground chambers for anchoring above ground structures, for coal and ore mining and for drilling water wells. The advantage is that from a pilot hole of about 5 inches diameter, a chamber of up to about 50 inches diameter can be formed at essentially any point underground. This reaming to a larger diameter can be done in a single pass or in multiple passes. A single pass would be used when working in soft formations. However, in oil and gas well use, the diameter will be increased sequentially to incrementally expose a new part of the formation. The reason is to expose new unplugged formation. Such new formation will have a greater flow rate of oil and gas.

The greatest use of the present reaming tool will be in the oil and gas industry. The flow rates of many wells can be increased by exposing new formation. The procedure involves using a casing cutter or a drill pipe mill to remove the casing and then using the present reaming tool to cut into the formation. This is an inexpensive alternative to drilling a new hole at an adjacent location.

A prime and necessary feature of this reaming tool is having cutting arms which will not permanently deflect, i.e., bend, while in use, but rather snap if an overload situation occurs. This is a necessary feature since in order for the tool to be removed from the hole it is necessary for the cutting arms to retract into mating side areas of the tool. If the cutting arms have been bent or otherwise permanently deflected from their original shape and contour, they will not fully retract. The net result would be that the tool cannot be removed from the hole. The hole would then have to be abandoned or a milling tool put down the hole to grind away the jammed tool. Milling away the jammed tool would take several days. This is expensive. The abandonment of a hole is also expensive. However, if arms are used which fracture rather than bend, the fractured section will fall to the bottom of the hole along with other debris. The remaining part of the arm will properly retract and the tool can be removed from the hole. Once removed, the remnant of the fractured cutting arm can be replaced and the tool reused.

The reamer tools presently in use do not use a material of construction whereby the cutter arms, pins and other parts of the tool which get stressed will fracture rather than bend. These tools are constructed of steels having low Rockwell C hardnesses of about 30 to 33. As a result, the cutter arms on these tools can extend only up to about five times the diameter of the tool. In this way, the stress on the cutter arms will in normal operation not exceed the point where the arm is permanently deflected. Many prior art tools, to solve this problem, use bracing members for the cutter arms.

Illustrative of the prior art reamer tools which use bracing members are U.S. Pat. No. 2,910,274 and U.S. Pat. No. 4,169,510. Also in neither of these tools are the cutter arms extendable to a position perpendicular to the tool body. At most they appear to go to a 45° angle with the tool body. Reamer tools which do not require bracing supports are illustrated by U.S. Pat. No. 2,743,904 and U.S. Pat. No. 3,757,877. However, in each of these tools the cutter arms extend only to about a 45° angle to the tool body. Prior art tools which are related in structure to reamer tools are wall scrapers. However, the extendable arms on these tools will extend up to only about three times the diameter of the tool body for smaller diameter tool bodies up to about six times the diameter of larger diameter tool bodies. The larger diameter tool bodies permit a better attachment of the cutter arms to the tool body.

It has been found that a narrow diameter underground reaming tools can be used to ream a hole to a diameter at least 10 times the diameter of the tool if a high impact steel of a Rockwell C hardness of at least 44 to 62 is used. Such a hardened steel has a high strength but if subjected to excessive stresses will fracture rather than bend. The Sheperd Fracture Rating is more than 6.5. The requirements of high strength and a hardness whereby the cutting arm fractures rather than bends, is necessary for the present tool. Materials which do not have these properties will not be operable.

This reaming tool is most advantageously used in combination with an actuator member which contains an indicator. This actuator provides a means of detecting a measurable hydraulic pressure differential when an internal piston moves downward axially as the reaming tool cutter arms open to an adjustable and predetermined position. This pressure differential can be sensed on the surface and is used to indicate the degree of extension of the cutter arms of the reamer tool.

In brief summary, this invention comprises a reamer tool which is capable of enlargening a hole to more than ten times the tool diameter. This reamer tool is constructed of a high impact steel material having a Rockwell C hardness of 44 to 62. It is necessary that the cutter arms be constructed of such a material. In use, the cutter arms of the tool extend upward and as the tool is rotated through rotation of the drill string, the cutter arms cut into the formation. The reamer tool is kept at the same level in the hole and as the tool rotates a bell shaped hole is formed. After the cutter arms are fully extended, the tool can be rotated while an upward force is put on the tool to ream the hole to the diameter of the two extended arms plus the tool body. Also, after the cutter arms are extended, when there are cutting surfaces on both the upper and lower part of the cutter arms, the bell shaped part of the hole can be reamed to a constant diameter by allowing a sufficient downward force from the weight of the drill string to force the tool downwards during rotation.

The invention also consists of the reamer tool in combination with an actuator member. The actuator member provides an elevated pressure to the reamer tool to extend the cutter arms, a signal when the cutter arms are extended, and thereafter sufficient high pressure to keep the cutter arms extended. This is accomplished through the use of two pistons. An upper high pressure piston acts on a lower drive piston which in turn operates on the piston in the reamer tool which extends the cutter arms. There is an aligned conduit through the center of each of these pistons for the flow of pressurized drilling fluid. The pressurized drilling fluid provides the force necessary to keep the cutter arms extended, lubrication for the tool against the formation, and a carrier for the cuttings to the top of the hole.

The invention will now be described with particular reference to the following drawings.

The reamer tool will be described with reference to the drawings and for a tool having an outside diameter (O.D.) of 4.5 inches. A tool having an O.D. of 4.5 inches is used in oil and gas wells having nominal 5 inch internal diameter (I.D.) casings. The 0.5 inch clearance between the tool and the casing provides the space for the drilling fluid to pass the tool and carry cuttings to the surface. The drilling fluid will also provide some lubrication of the tool in the casing. The tool will rotate in the casing at a rate of about 25 to 125 revolutions per minute (rpm). These smaller diameter tools have a much lower mass than the larger diameter tools and consequently have more problems of tool strength. Size constraints of these tools require special engineering to acquire high strengths. All tools regardless of their O.D. will have a clearance for the circulation of the drilling fluid. Many tools will also have channels on their exterior surface for improved flow of drilling fluid.

The material construction of the present reamer tools must have Rockwell C hardness of at least 44 to 62 and preferably a Shepherd Fracture Rating of more than 6.5. A useful material A1S1 Type S7 steel. This high impact strength steel has a nominal analysis by weight of other than iron of:

Carbon: 0.50%
Manganese: 0.50%
Silicon: 0.25%
Chromium: 3.25%
Molybdenum: 1.45%

This steel can be hardened to a Rockwell C hardness of 44.0 to 60.0 through air cooling and to a Rockwell C hardness of 62 through oil quenching. These Rockwell C hardnesses equate to Shepherd Fracture Ratings of 6.5 to 9. A steel of this type is available from A1 Tech Specialty Steel Corporation.

Figure 1:
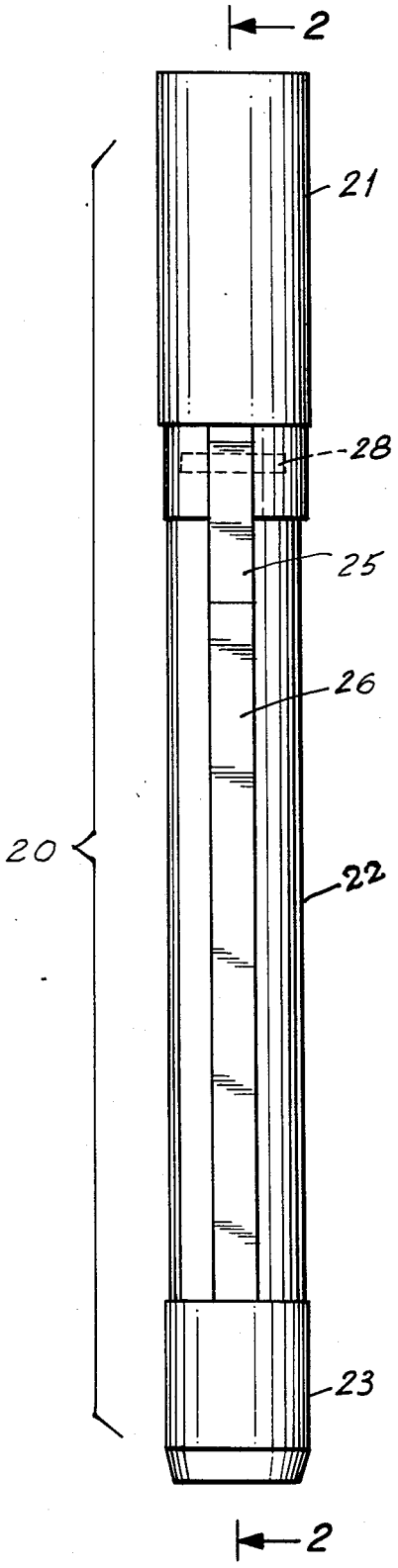
FIG. 1 is an elevational view of the reamer tool.

FIG. 1 shows the reamer tool 20 in elevation. The upper portion 21 of the tool body is attached to other parts of the drill string. The center portion 22 of the tool body carries cutter arms 25 which pivot and are held in place by arm retaining pins 28. Cutter arm pocket recesses 24 contain the cutter arms when they are not extended. The cutter arms are maintained in the recesses when the tool is lowered into or taken from the hole. The lower portion 23 can be connected to another item depending on the particular drilling operation.

Figure 2:
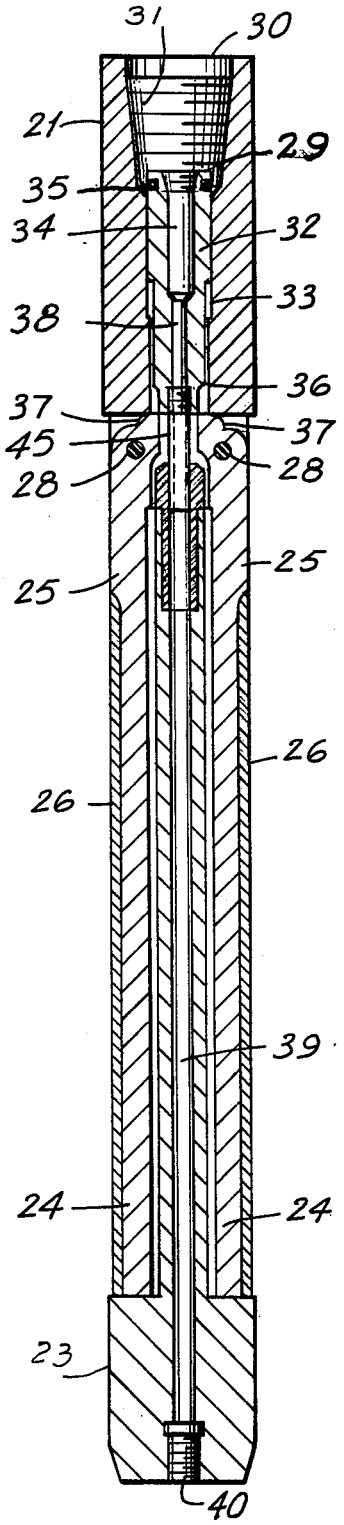
FIG. 2 is a sectional elevational view of the reamer tool of the FIG. 1 along line 2—2.

FIG. 2 is an elevational view in section along line 2—2 of FIG. 1. The upper part of the reaming tool carries threads 31. It is by means of this threaded opening 30 that the reaming tool is attached to other parts of the drill string. Below the opening is piston 32 which travels in bore 33. The piston has an O-Ring seal 35 with the bore and has a conduit 34 in the center for the passage of drilling fluid. This piston has an upper surface 29 and a lower surface 36 which contacts surface 37 of each cutter arm 25. Each cutter arm has an upper cutting surface 26. Extending downward through piston 32 is a continued conduit 38 for carrying drilling fluid thru a wash tube 45. This wash tube 45 slideably extends into cutter arm rest bushing 42 which is shown in more detail in FIG. 3. Conduit 39 carries the drilling fluid from the cutter arm rest bushing through the lower part of the reamer tool to an exit opening 40. This exit opening is shown as being threaded but this need not be the case.

Figure 3:
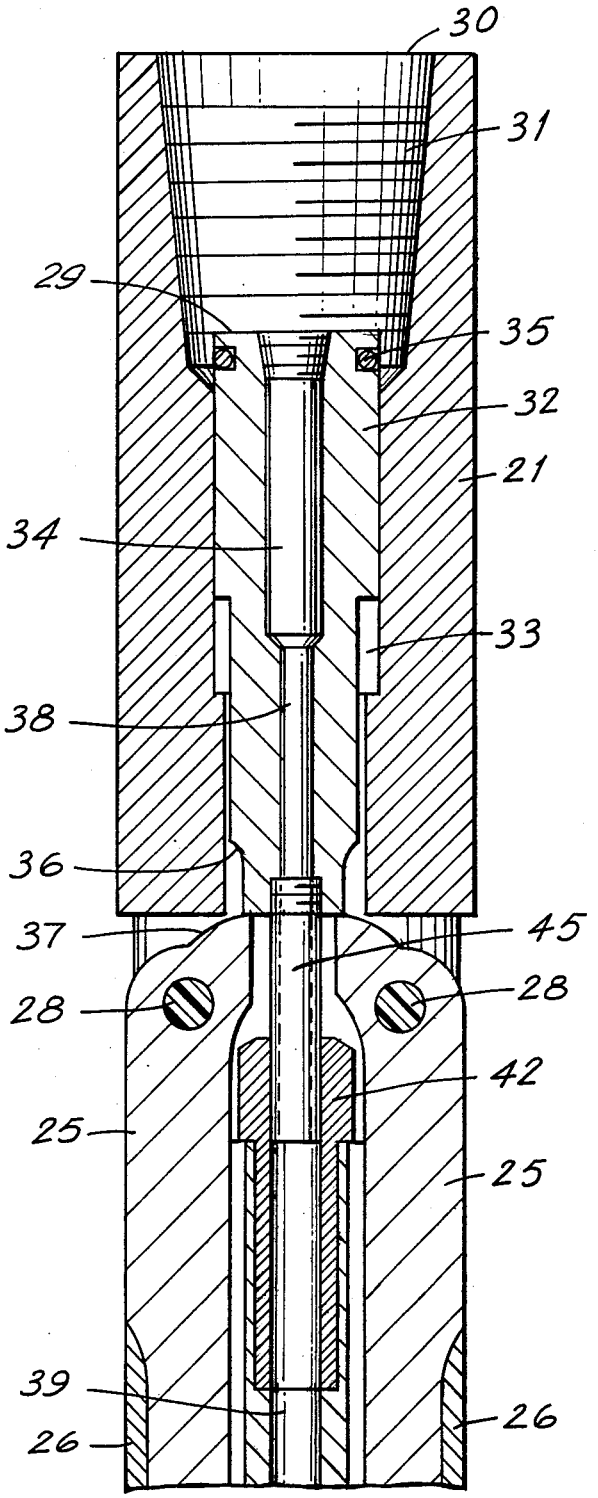
FIG. 3 is a sectional elevational view of the upper portion of the reamer tool of FIG. 2 showing the cutter arms within the reamer tool body.

FIG. 3 shows the upper portion of the reamer tool enlarged and in more detail. This view also shows the reamer tool with the cutter arms within the pocket recesses of the tool. The reamer tool is inserted down the hole to be enlarged in this condition. In addition, this view shows cutter arm rest bushing 42 in more detail. This consists of bushing 42 which has mounted thereto conduit section 39. When piston 32 moves downward, wash tube 45 slideably moves within bushing 42. When the tool is in operation, drilling fluid passes through conduits 34, 38, to the wash tube 45 and conduit 39 to the bottom of the reamer tool. The drilling fluid then picks up cuttings and takes them to the surface.

Figure 4:
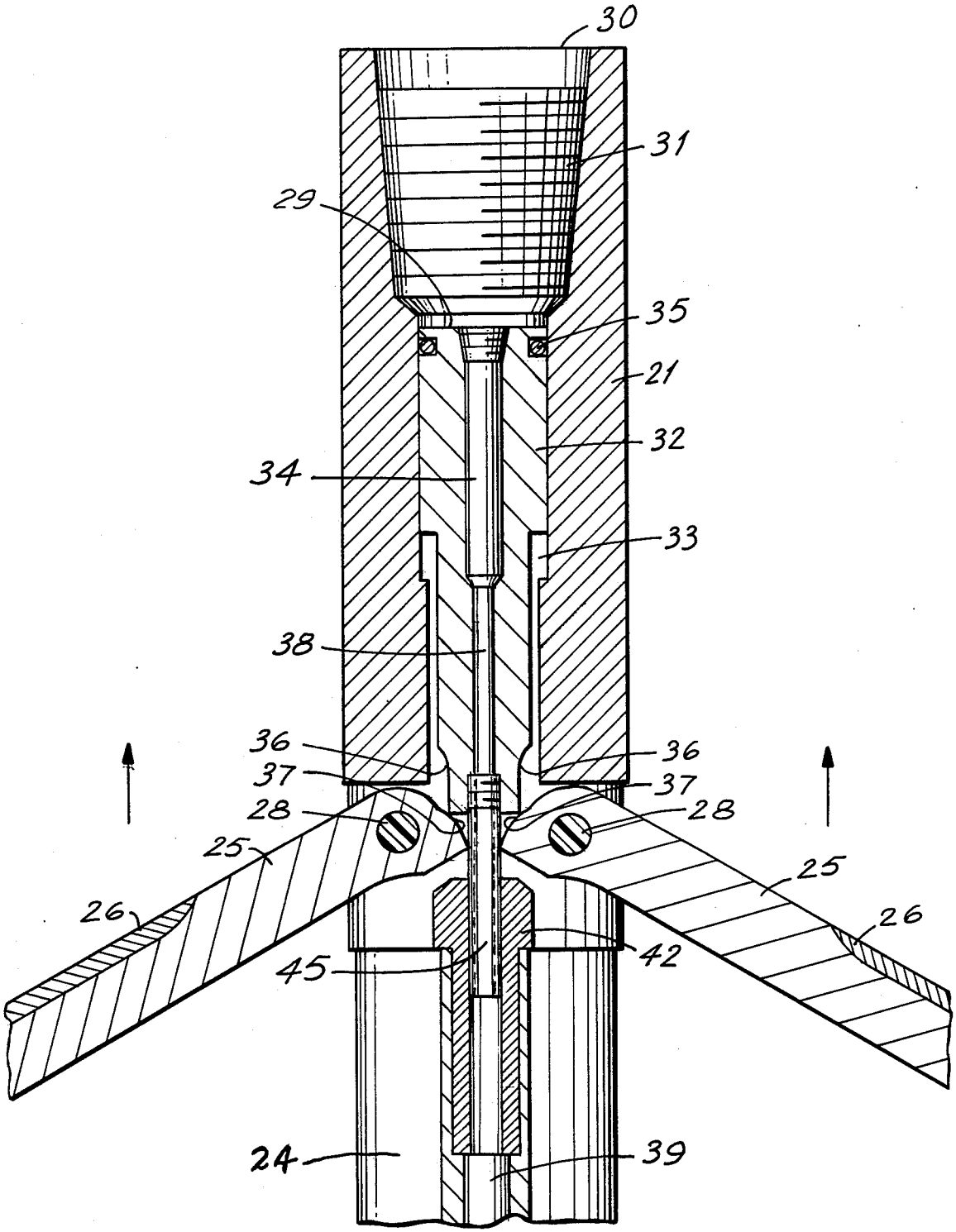
FIG. 4 is a sectional view of the upper portion of the reamer tool of FIG. 2 showing the cutter arms partially extended.
Figure 5:
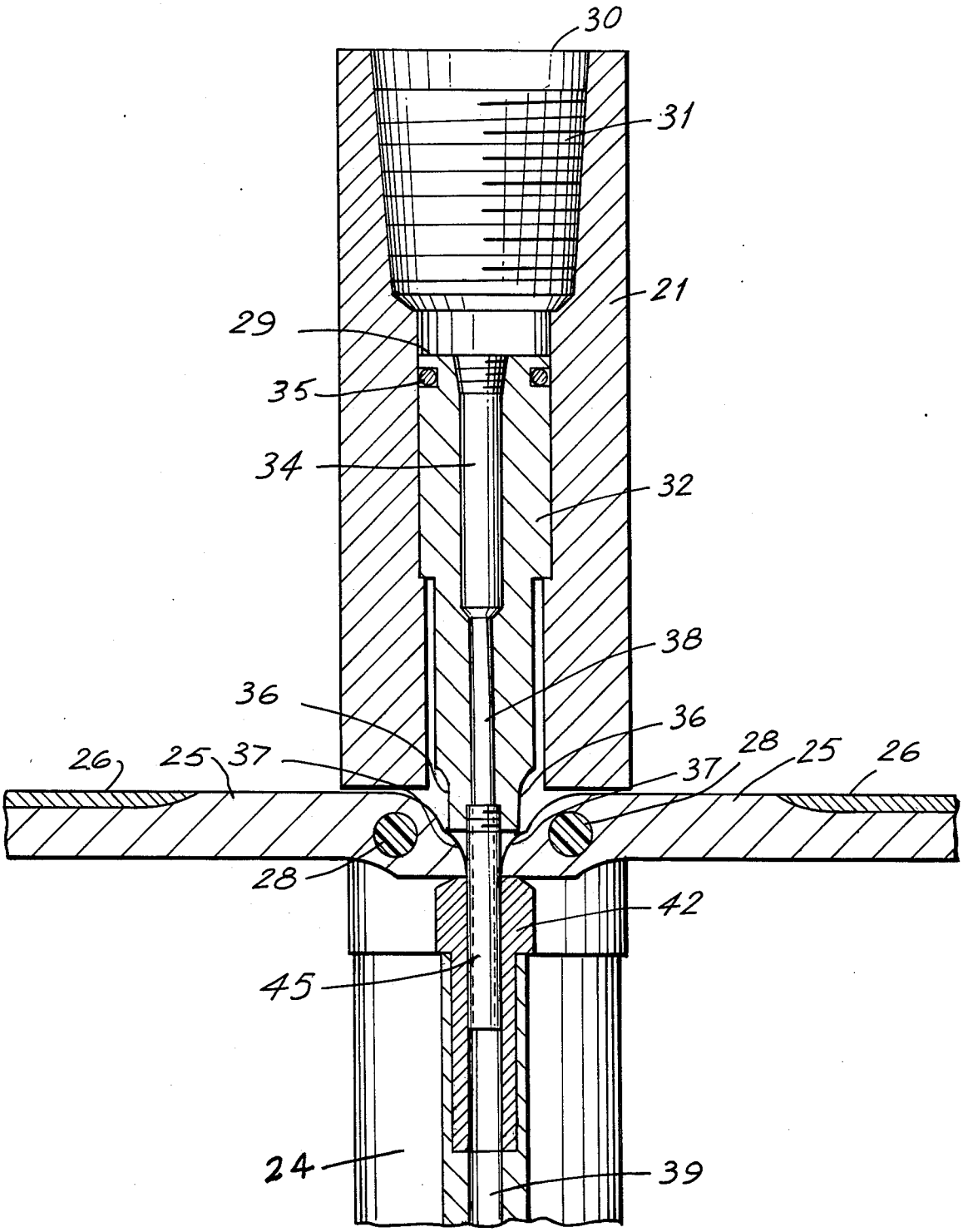
FIG. 5 is a sectional elevational view of the upper portion of the reamer tool of FIG. 2 showing the cutter arms fully extended.

FIG. 4 shows the upper section of the reamer tool with the cutter arms partially extended. Here piston 32 has been driven downward in bore 33 whereby lower surface 36 of the piston has contacted surface 37 of the cutter arms causing the cutter arms to extend outwardly. Also this view shows wash tube 45 having extended downward into bushing 42. FIG. 5 shows the cutter arms fully extended as a result of piston 32 having traveled the full axial length of bore 33.

Figure 6:
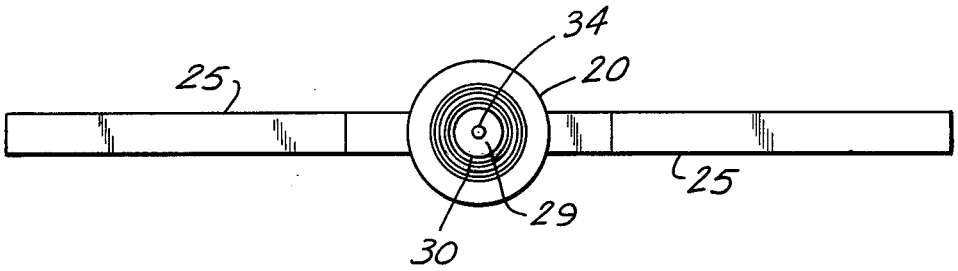
FIG. 6 is a top plan view of the reamer tool of FIG. 1 showing the use of two cutter arms.
Figure 7:
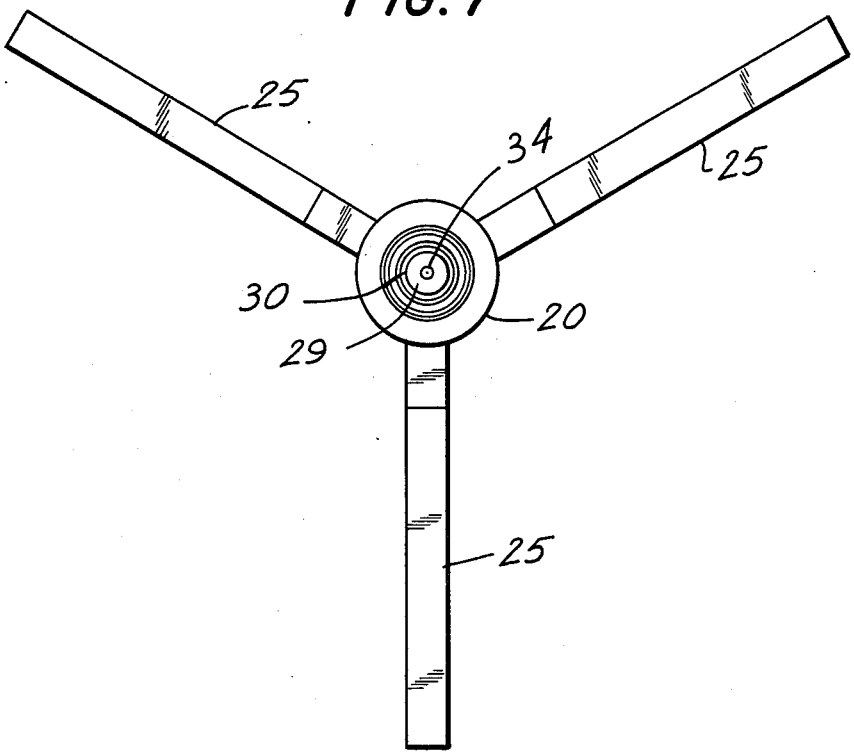
FIG. 7 is a top plan view of the reamer tool of FIG. 1 showing the use of three cutter arms.

FIG. 6 and FIG. 7 show a reamer tool having two and three cutter arms. This is a top plan view of the reamer tool having the cutter arms fully extended. It is preferred to use a tool having three cutter arms. This provides for good cutting action and yields good tool stability in the hole.

Figure 8:
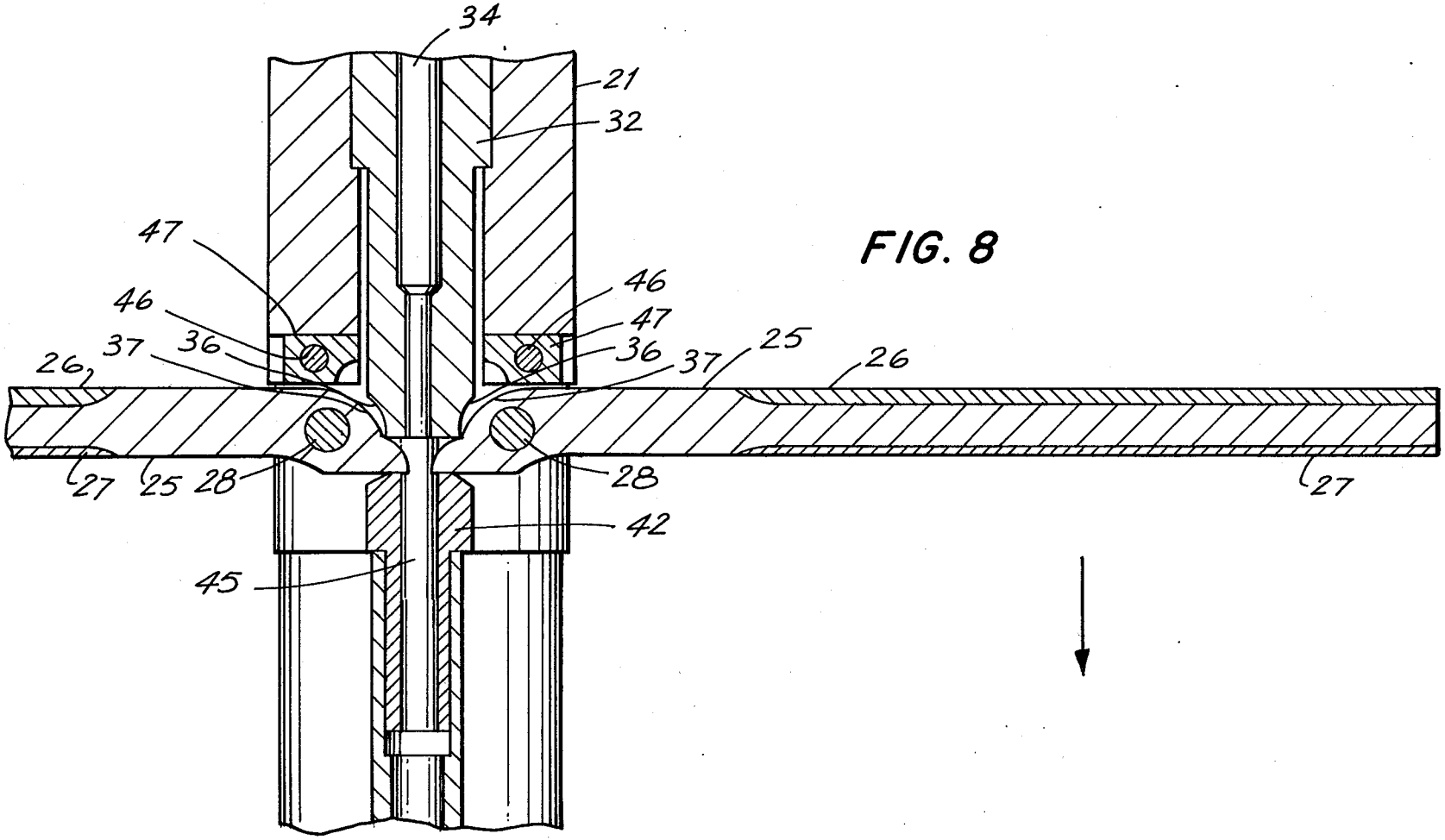
FIG. 8 is a sectional elevational view of the reamer tool showing cutting surfaces on the upper portion and on the lower portion of each cutter arm.

FIG. 8 shows an embodiment of the reamer tool in a position to cut a formation in an upward or downward direction with cutter support 47 added. These supports are held in position by pins 46. When cutting downward, cutting surface 27 of each arm is the working surface while cutting upward cutting surface 26 is the working surface. In this arrangement hardened blocks 47 support the cutter arms from the upward forces resulting from the reamer tool cutting downward. This is a preferred embodiment of the reamer tool since it permits the hole to be reamed upwardly to a bell shape, and then downward to a constant diameter.

Figure 9:
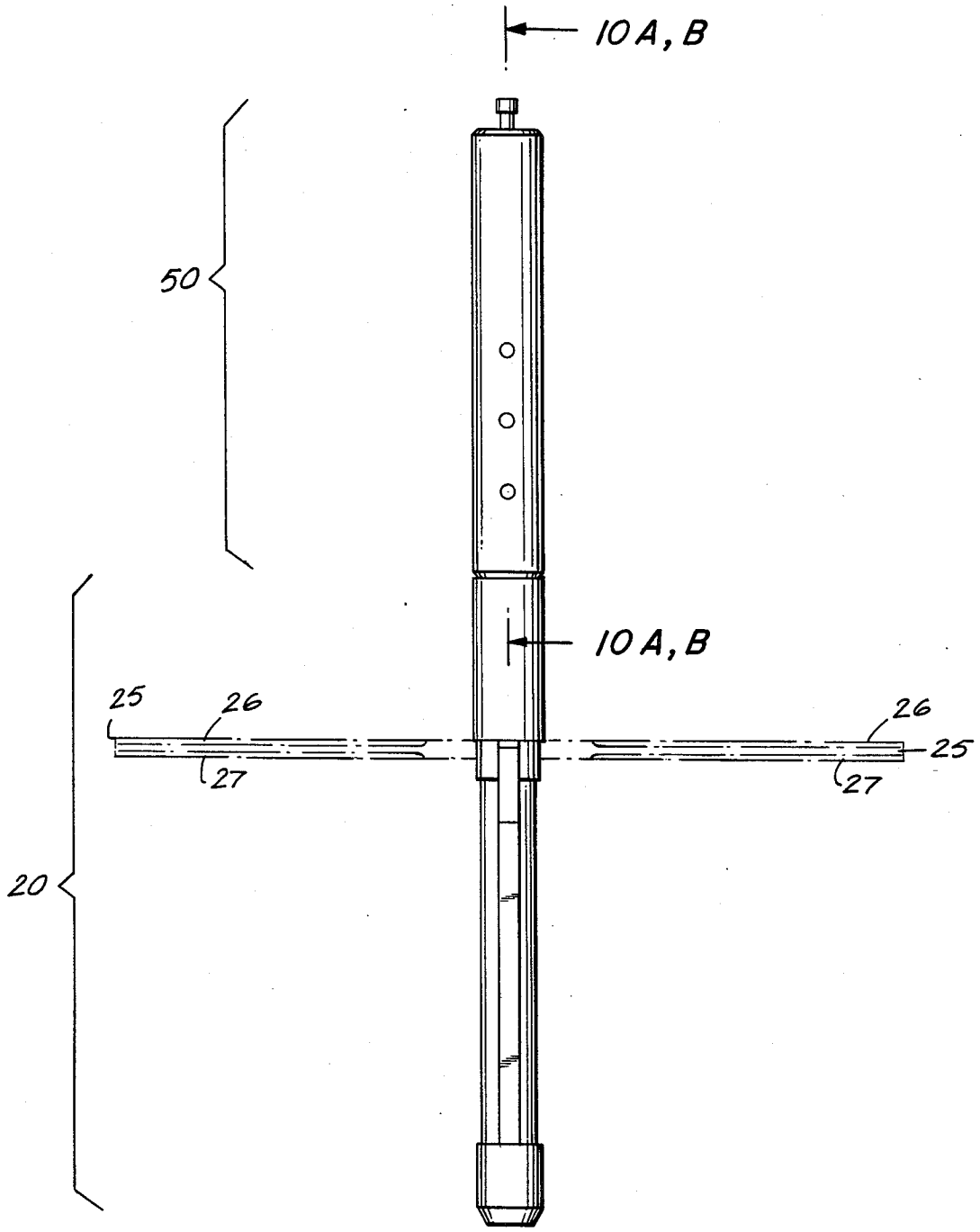
FIG. 9 is an elevational view of the reamer tool of FIG. 1 in combination with the upper actuator member.
Figure 10A:
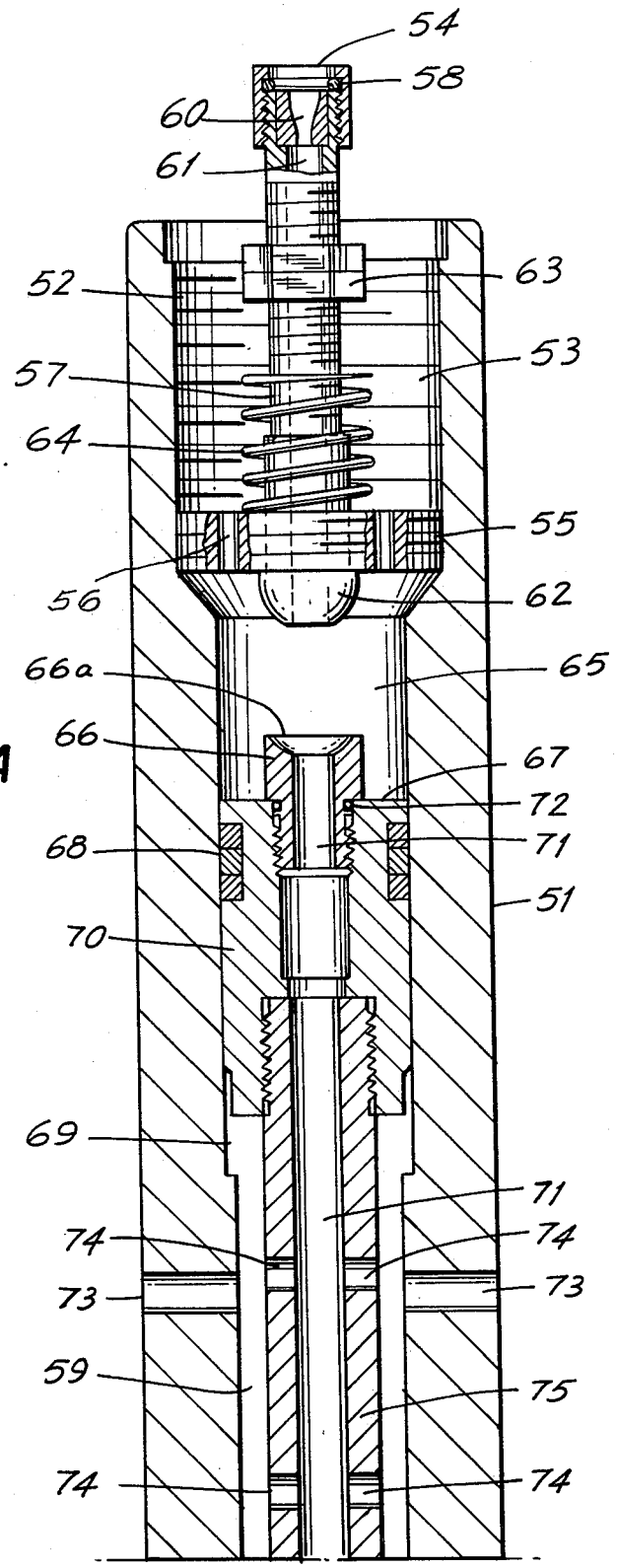
FIG. 10A is a sectional elevational view of the upper portion of the reamer tool actuator member.
Figure 10B:
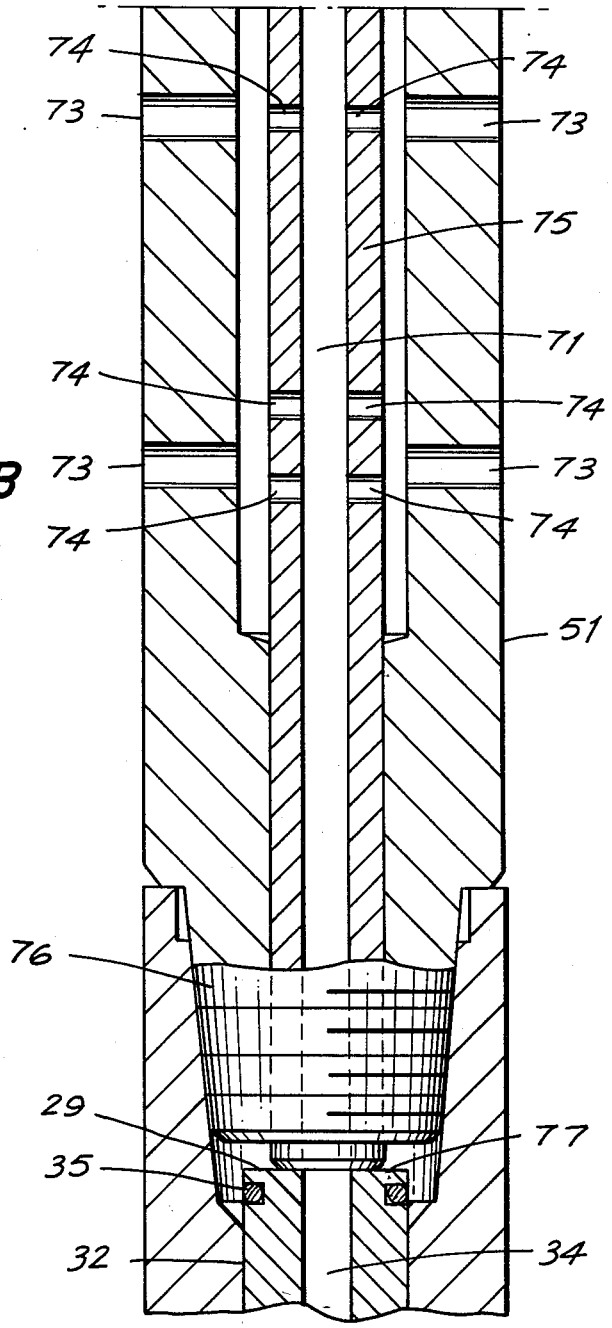
FIG. 10B is a sectional elevational view of the lower portion of the reamer tool actuator member.

FIG. 9 shows the reamer tool 20 interconnected to the actuating member 50. The actuating member functions to operate cutter arm piston 32. These two pieces of equipment are joined via a threaded connection. FIGS. 10A and 10B show in more detail the construction of this actuating member. The upper portion is shown in FIG. 10A and the lower portion is shown in FIG. 10B.

The actuating member consists primarily of two moving parts. The piston 70 actuates the cutter arm piston 32 of the reamer tool while indicator stem 57 functions to initially activate piston 70.

In more detail and with reference to FIG. 10A actuating piston 70 travels logitudinally in bore 69. O-ring 68 seals the lower piston in this bore. Conduit 71 with upper opening in indicator busing 66 passes downward through the piston. The upper surface 66(*a*) of indicator busing 66 is shaped to mate with lower surface 62 of indicator stem 57. Threadedly connected to the lower part of piston 70 is piston wash tube 75. Conduit 71 extends downward through piston wash tube 75 which has passages 74 to permit some drilling fluid in conduit 71 to pass to the exterior surface 51 of the actuating member through space 59 and then via passages 73. Passages 74 can be of the same or different diameters. It is preferred that the upper passages be of a larger diameter than the lower passages in order to equalize the flow of drilling fluid. Passages 73 have a larger diameter than passages 74. These passages permit a flow of a greater volume of drilling fluid since the narrow drilling fluid conduit sizes in the reamer tool restrict flow. An O-ring 72 seals indicator bushing 66 to piston surface 67. The indicator stem 57 has an exterior threaded surface on which travel limiting nut 63 can be adjusted. Around the outside of this threaded surface is spring 64 which serves to return the indicator stem to the rest position. This indicator stem has a conduit 61 therethrough with orifice 60 and orifice retaining nut 54 in the upper end. An O-ring 58 seals a conduit bringing drilling fluid from the surface to orifice 60. Surrounding indicator stem 57 is chamber 53 formed by threaded sidewall 52 and spider 55 which functions as a bulkhead. Spider 55 has radial slot 56 permitting chamber 53 to cummunicate with chamber 65 which is formed by actuator member sidewall 51, spider 55 and piston 70. The radial slot is about 100 times the area of orifice 60. This chamber 65 will change in volume depending on the movement of piston 70. Chamber 53 will be of a constant volume.

FIG. 10B shows the structure of the lower part of the actuating member. Lower threaded area 76 of the actuating member is threadedly engaged in the threaded section 31 of the reamer tool. In operation, surface 77 of piston wash tube 75 drives cutter arm piston 32 downward to extend the cutter arms. Drilling fluid flows through conduit 71 and into conduit 34 of the reaming tool.

Figure 11:
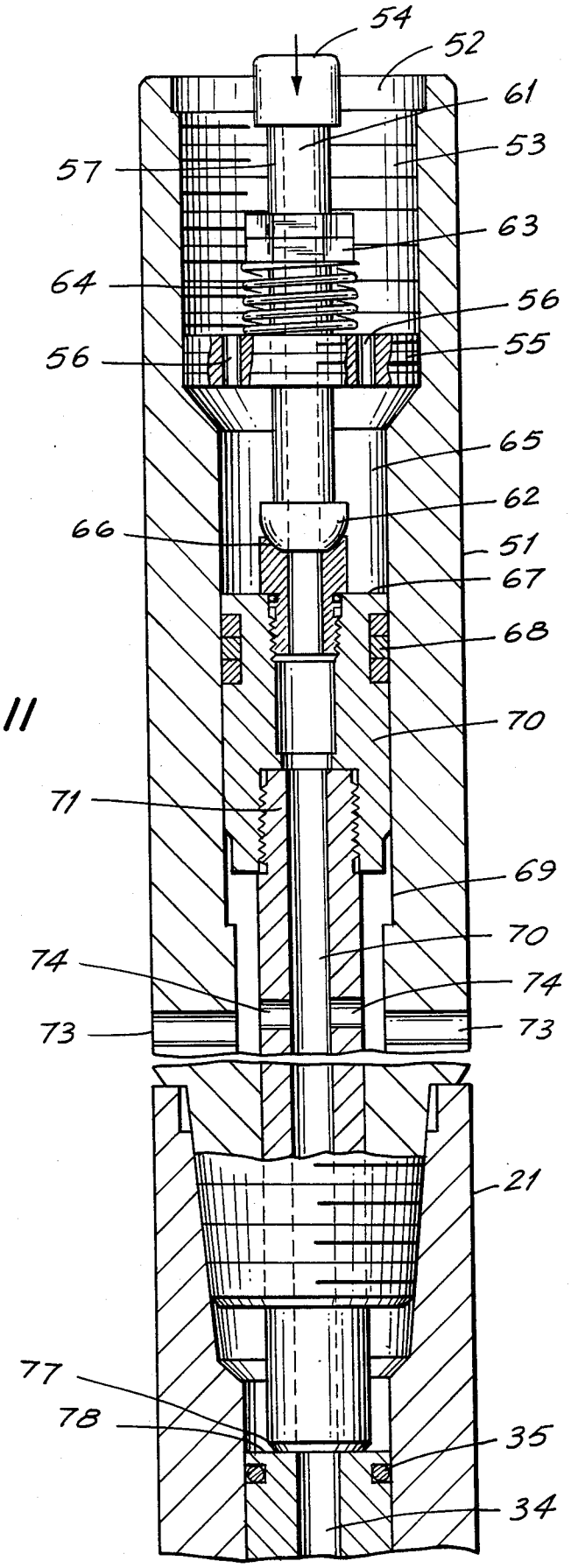
FIG. 11 is a sectional elevational view of the reamer tool actuator member showing the delivery of high pressure fluid to extend the reamer tool cutter arms.
Figure 12:
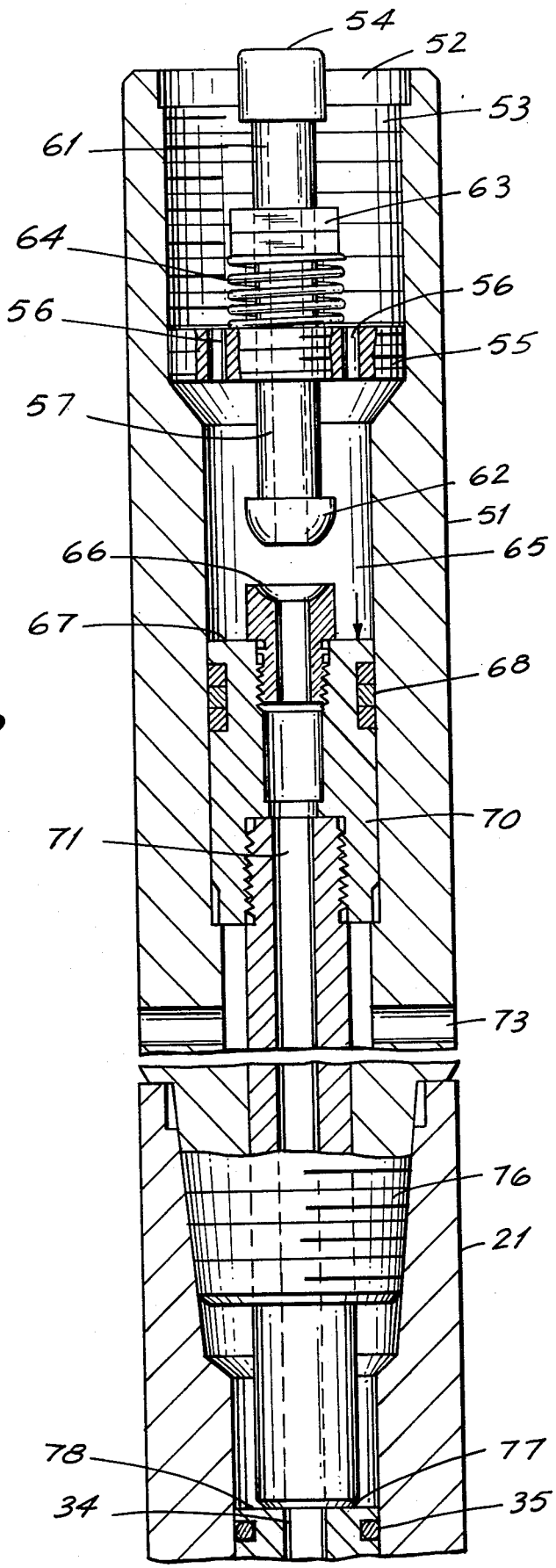
FIG. 12 is a sectional elevational view of the reamer tool actuator member showing the delivery of pressurized drilling fluid subsequent to the extension of the reamer tool cutter arms.

FIG. 11 shows the actuating member in operation. In this view, the high pressure drilling fluid has depressed indicator stem 57 downward so that lower surface 62 of this piston mates with the upper surface 66(*a*) of indicating bushing 66 of piston 70. Pressurized drilling fluid at this time is flowing down through the actuating member to the reaming tool and also fills chambers 53 and 65. The drilling fluid in chamber 65 works on surface 67 of piston 70. Also, during this time, piston 70 is constantly moving downward. When indicator stem 57 has reached its travel limit through the engagement of limiting nut 63 with spider 55, fluid from chamber 65 will flow through conduit 71. At this point, lower surface 62 of indicator stem 57 disengages from the mating surface of the indicator bushing. Spring 64 brings the indicator stem 57 to a rest position. At the time of the disengagement of the indicator stem from the indicator bushing there is a measureable change in drilling fluid pressure due to the ability of more drilling fluid being able to flow. This pressure change can be monitored at the surface and used as an indication of when the cutter arms have extended to a prearranged position. This is usually a position where the cutter arms have fully reamed the formation. The pressure in the actuator member is maintained only by drilling fluid pumped from the surface. The reamer tool is rotated during the full time that pressurized drilling fluid is being fed to the tool. This reamer tool is very useful in enlarging small holes of about five inches I.D. to five to ten times this diameter of the hole. However, to be effective in such usage, the casing, cutter arms, and pistons of a reamer tool must be constructed of a high impact steel having a Rockwell C hardness of 44 to 62. As noted above, this must be a steel such as A1S1 S7 or an equivalent for high impact properties.

The prime use of this reamer tool is to widen narrow diameter holes. That is, for instance, to widen a nominal five inch diameter hole to up to 50 inches. Most oil and gas wells are drilled to have an internal diameter of about five to eight inches after the installation of the casing and in this range a five inch internal diameter hole is preferred. The reason is that a smaller diameter hole is less costly to drill. However, with the present reamer tool, a five inch diameter hole can be enlarged to a 45 to 50 inch diameter hole at selected points. This provides flexibility in drilling holes for the production of oil and gas.

In use the reamer tool with the associated actuator member is lowered to a set level in a formation via a drill string, the drill string rotated and pressurized drilling fluid fed down the drill string to the actuator member and reamer tool. This causes the cutter arms to bite and cut into the formation. After the cutter arms have extended to a point 90° to the tool body, or to a set intermediate point, tool rotation and the pressurized flow of drilling fluid is stopped. The tool can then be withdrawn from the hole. However, options are to continue to drill upwards, or to cut downwards if the cutter arms are extended to a position of 90° to the tool body. If the formation is to be cut downwards the cutter arms having two cutting surfaces would be used.

This reamer tool can can be modified in various ways to fit specific needs. However, if such a tool had cutting arms which could extend to a position perpendicular to the tool body, and the length of the arms could be up to ten times or more the diameter of tool body, it would be within the present discovery.

We claim:

1. An apparatus for reaming a hole drilled in the earth comprising:

(a) a rotatable tool body;

(b) a plurality of high strength elongated cutter arms having an upper end and a lower end, said cutter arms pivotably mounted on said rotable tool body at the upper end of each cutter arm and adapted to be removed outwardly and upwardly; and (c) said cutter arms comprised of a high impact steel having a Rockwell C hardness of at least about 44 to 62 whereby said cutter arms fracture prior to undergoing a permanent deflection.

2. An apparatus for reaming a hole in the earth as in claim 1, wherein said cutter arms are comprised of a steel alloy having Shepherd Fracture Rating of at least about 6.5.

3. An apparatus for reaming a hole drilled in the earth as in claim 1, wherein said cutter arms have an upper surface and a lower surface and have cutting surfaces on the upper and lower surface of each cutter arms.

4. An apparatus for reaming a hole drilled in the earth as in claim 1, wherein the rotatable tool body is comprised of a steel has a Rockwell C hardness of at least about 44 to 62 and a Sheperd Fracture Rating of at least about 6.5.

5. An apparatus for reaming a hole drilled in the earth as in claim 1, comprising a piston having an upper surface and a lower surface and longitudinally disposed within said rotable tool body, the upper surface of said piston subject to applied pressure and the lower surface of said piston acting on the end of each cutter arm to move each cutter arm outwardly.

6. An apparatus for reaming a hole in the earth as in claim 5, wherein said cutter arms extend outwardly to a position essentially perpendicular to the tool body.

7. An apparatus for reaming a hole in the earth as in claim 6, wherein said rotatable tool body is cylindrical and the length of said cutter arms to the diameter of said cylindrical rotatable tool body is in a ratio of at least about 5 to 1.

8. An apparatus for reaming a hole in the earth as in claim 7, wherein the length of said cutter arms to the diameter of said rotatable tool body is in a ratio of at least about 6 to 1.

9. An apparatus for reaming a hole drilled in the earth as in claim 5 wherein said rotatable tool body and said piston have a conduit axially therethrough for the passage of drilling fluid.

10. An apparatus for reaming a hole drilled in the earth as in claim 1 comprising a longitudinally disposed piston in the upper portion of said rotatable tool body, the upper surface of said piston adapted to be contacted by an actuating piston, and the lower surface of said piston adapted to contact and pivot said pivotably mounted cutter arms.

11. An apparatus for reaming a hole drilled in the earth as in claim 10 wherein there are at least two cutter arms.

12. An apparatus for reaming a hole drilled in the earth as in claim 11 wherein there is a cutting surface on the upper and lower surface of said cutter arms.

13. An apparatus for reaming a hole drilled in the earth as in claim 1 comprising an actuator member removably attached to the upper end of said rotatable tool body to actuate a piston in said rotatable tool body and extend said cutter arms.

14. An apparatus for reaming a hole drilled in the earth as in claim 13 wherein said actuator member comprises a longitudinally moveable actuating piston having an upper surface and a lower surface and a conduit axially therethrough for the delivery of drilling fluid to said rotatable tool body, the upper surface of said actuating piston contacted by an indicator stem which is longitudinally moveable, the lower surface of said actuating piston adapted to contact the upper surface of a longitudinally disposed piston in said rotatable tool body which moves said cutter arms outwardly.

15. An apparatus for reaming a hole drilled in the earth as in claim 14 wherein said conduit through said actuating piston communicates with a plurality of passages to an exterior surface of said actuator member whereby drilling fluid may pass to the exterior of said member and to said rotatable tool body.

16. An apparatus for reaming a hole drilled in the earth as in claim 14 comprising a conduit through said indicator stem, said conduit being in alignment with the conduit through said actuating piston.

17. An apparatus for reaming a hole drilled in the earth as in claim 16 wherein said conduit through said actuating piston is in alignment with a conduit in said longitudinally disposed piston in said rotatable tool body.

18. An apparatus for reaming a hole drilled in the earth in claim 16 wherein said indicator stem has means to limit the longitudinal movement thereof and means to return said indicator stem.

19. An apparatus for reaming a hole drilled in the earth as in claim 18 wherein said means to return said indicator stem is a spring.

20. An apparatus for reaming a hole drilled in the earth as in claim 14 wherein there are at least two cutter arms.

21. An apparatus for reaming a hole drilled in the earth as in claim 20 wherein there is a cutting surface on a upper and a lower surface of said cutter arms.

22. A method for reaming a hole drilled in the earth from a diameter of about the outside diameter of a reamer tool body having a diameter of up to seven inches to essentially a constant diameter of at least five times the diameter of said reamer tool body in an upwardly or downwardly direction comprising:

(a) lowering a reamer tool having a plurality of cutter arms having cutting surfaces on upper and lower surfaces of said cutter arms into a hole to the location where the diameter of said hole is to be expanded;

(b) flowing drilling fluid under pressure to said reamer tool whereby the cutter arms of said reamer tool extend outwardly;

(c) rotating said reamer tool whereby said cutter arms cut into a formation and continue to extend outwardly and upwardly;

(d) cease rotating said reamer tool when said cutter arms have extended to predetermined angle from the body of said reamer tool; and (e) rotate said reamer tool while applying a downward force to cut the formation downwardly to essentially a constant diameter.

23. A method for reaming a hole drilled in the earth as in claim 22 wherein there are at least two cutter arms.

24. A method for reaming a hole drilled in the earth as in claim 23 wherein when said cutter arms of said reamer tool extend outward to a predetermined angle, the pressure of said drilling fluid fluctuates to thereby indicate that said cutter arms are extended to said predetermined angle.

* * * * *